US008075425B2

(12) United States Patent
Conwright

(10) Patent No.: US 8,075,425 B2
(45) Date of Patent: Dec. 13, 2011

(54) METHOD FOR TEACHING A USER PROPER CROSSOVER DRIBBLING USING A BASKETBALL DRIBBLE DEVICE

(76) Inventor: Milton E. Conwright, Grand Prairie, TX (US)

( * ) Notice: Subject to any disclaimer, the term of this patent is extended or adjusted under 35 U.S.C. 154(b) by 0 days.

(21) Appl. No.: 13/135,302

(22) Filed: Jun. 30, 2011

(65) Prior Publication Data

US 2011/0263357 A1 Oct. 27, 2011

(51) Int. Cl.
*A63B 69/00* (2006.01)

(52) U.S. Cl. ..... 473/447; 473/422; 473/476

(58) Field of Classification Search ..... 473/422, 473/447, 446, 448, 433, 472, 479, 483; 434/248; 273/371; D21/686, 797; 482/14, 15, 17, 482/38, 41, 140, 141, 908
See application file for complete search history.

(56) References Cited

U.S. PATENT DOCUMENTS

| | | | | |
|---|---|---|---|---|
| 1,784,818 | A * | 12/1930 | Bump | 473/410 |
| 3,865,375 | A * | 2/1975 | Cosgrove | 273/118 R |
| 4,008,892 | A * | 2/1977 | Nissen | 482/16 |
| 4,538,808 | A * | 9/1985 | Holland | 473/447 |
| 5,334,121 | A * | 8/1994 | McPhilomy | 482/17 |
| 5,553,863 | A * | 9/1996 | Wynne | 473/478 |
| 5,599,016 | A * | 2/1997 | Larkin | 473/448 |
| 5,813,926 | A * | 9/1998 | Vance | 473/448 |
| 6,213,899 | B1 * | 4/2001 | Maske | 473/409 |
| 6,312,349 | B1 * | 11/2001 | Roberts | 473/448 |
| 6,544,132 | B1 * | 4/2003 | Tvedt | 473/448 |
| 6,679,794 | B1 * | 1/2004 | Vitello et al. | 473/433 |
| 7,175,549 | B2 * | 2/2007 | LeFlore | 473/448 |
| 7,476,187 | B2 * | 1/2009 | Corte | 482/141 |
| 2004/0005939 | A1 * | 1/2004 | Bourguet | 473/447 |

* cited by examiner

*Primary Examiner* — Mitra Aryanpour
(74) *Attorney, Agent, or Firm* — Lynn E. Barber

(57) ABSTRACT

A basketball dribble device is provided that has two legs, with each leg; and a rigid cross-member extending between the tops of the legs. A method of teaching a player to cross-dribble uses the basketball dribble device.

8 Claims, 2 Drawing Sheets

METHOD FOR TEACHING A USER PROPER CROSSOVER DRIBBLING USING A BASKETBALL DRIBBLE DEVICE

CROSS-REFERENCE TO RELATED APPLICATIONS

This application claims priority from co-pending U.S. patent application Ser. No. 12/154,625 filed May 23, 2008, which claims priority from U.S. provisional application Ser. No. 61/000,247 filed Oct. 24, 2007.

BACKGROUND OF THE INVENTION

1. Field of the Invention

This invention relates to physical education and sports training devices, and in particular, relates to a device for teaching crossover dribbling in basketball.

2. Description of the Related Art

Basketball, like other sports, requires that specific skills be taught and practiced. One such skill is that of dribbling the ball, and one valuable dribbling skill is that of crossover dribbling, in which the skilled player dribbles the ball with the dominant hand, and then quickly switches the ball to the other hand with a quick, low bounce. This is ideally a low quick bounce right in front of the opponent that accompanied by a change in direction. This allows the player to confuse the opponent as to the direction of play and switch directions.

Typically crossover dribbling is taught by using a cone, such as a traffic cone, and having the player approach it and then try the crossover dribble close to the cone. This technique, however, does not force the player to do the crossover dribble in a particular place and does not force the player to do a low dribble at that place.

While there are prior devices that are designed to teach dribbling skills, such as the patent of Bourguet (U.S. Patent Application No. 2004/0005939 for a support for the ball to keep it from rolling away), as well as numerous devices designed to teach players to shoot the basketball, there is not a prior device that allows a player to learn and practice crossover dribbling.

It is therefore an object of the invention to provide a basketball dribble device that can be used by a player to learn and practice crossover dribbling.

Other objects and advantages will be more fully apparent from the following disclosure and appended claims.

SUMMARY OF THE INVENTION

The invention herein is a basket ball dribble device that has two legs, with each leg; and a rigid cross-member extending between the tops of the legs. Other objects and features of the inventions will be more fully apparent from the following disclosure and appended claims.

DETAILED DESCRIPTION OF THE INVENTION AND PREFERRED EMBODIMENTS THEREOF

Figure 1:
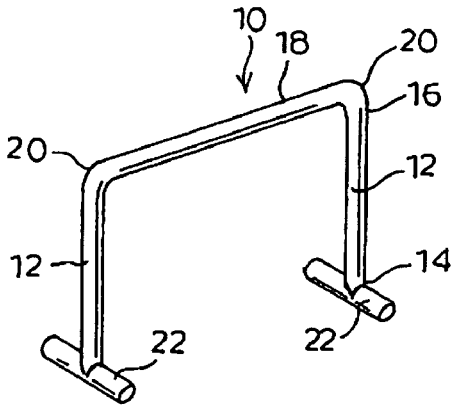
FIG. 1 is a perspective view of a one-piece basketball dribble device of the invention.

The present invention is a basketball dribble device 10, comprising: two legs 12, each leg having a lower end 14 and an upper area 16; and a rigid cross-member 18. As used herein, the term "rigid" means that the cross-member 18 does not sag or bend and holds its shape. The cross-member 18 has two ends 20 and extends between the upper areas 16 of the two legs 12. When the lower ends 14 of the two legs 12 of the basketball dribble device 10 are placed on a floor surface, the cross-member 18 is low enough to require that a ball being dribbled beneath the cross-member is being properly crossover dribbled. Preferably the distance between the lower ends 14 of the legs in the assembled device 10 is about 16 to 26 inches, so that a straight, horizontal cross-member 18 as shown in FIGS. 1-2 and 4-5 would be at least 15 inches long, and preferably no longer than 24 inches.

Figure 2:
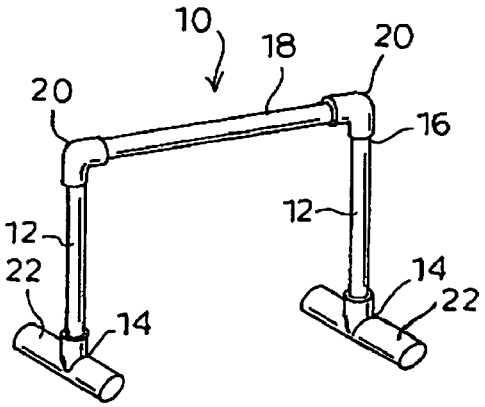
FIG. 2 is a perspective view of a multiple-piece basketball dribble device of the invention.

In the preferred embodiment, the basketball dribble device 10 has just two legs 12 and there is a support member 22 at the lower end 14 of each leg 12 to keep the device 10 from falling over as shown in FIGS. 1-3 and 5. The support member 22 is perpendicular to the leg 12 as shown in FIGS. 1-3 and 5. In the preferred embodiment this support member 22 is a T-shaped PVC pipe fitted to the lower end 14 of each leg 12 as shown in FIG. 2; however, it may be integrally made with the rest of the device as shown in FIG. 1.

Figure 6:
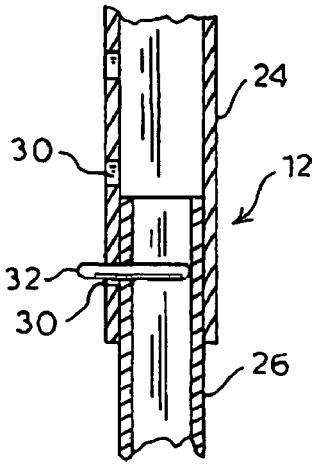
FIG. 6 is partial cross-sectional view of a leg of the basketball dribble device that is adjustable in height.

In order to teach and enable "proper crossover dribbling" defined herein for an adult as a dribble that is low enough to pass beneath a horizontal bar that is about 24 inches off the floor, the legs 12 are preferably no more than about 24 inches long. This device 10 can be made in different sizes and heights for particular players and skill levels of players without departing from the invention herein. In an alternative embodiment, the legs of the device 10 may be made to be adjustable in height, for example, with a pin 32 in an inner segment 26 and a plurality of holes 30 in an outer telescoping segment 24 as is known in the art as is shown in FIG. 6, or by any other means.

Figure 3:
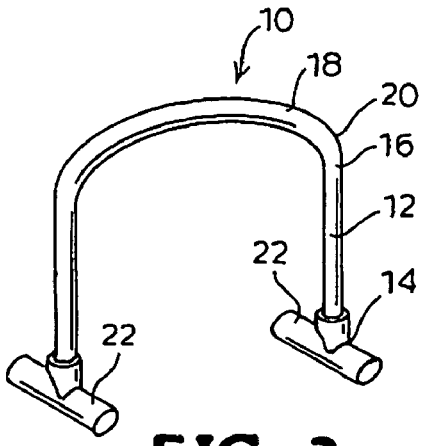
FIG. 3 is a perspective view of an arched basketball dribble device of the invention.
Figure 5:
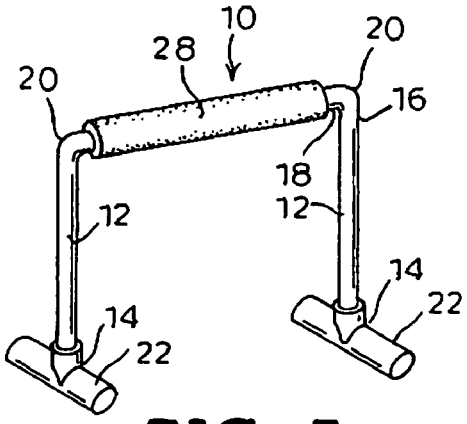
FIG. 5 is a perspective view of the basketball dribble device of the invention having a soft cover on the cross-member.

In the first preferred embodiment of the invention, the basketball dribble device of the cross-member is straight so that it is parallel to the floor surface when the base support members are placed on the floor surface as shown in FIGS. 1-2 and 5. Alternatively, the cross-member may be centrally arched as shown in FIG. 3. In the latter case, the method of forming the arch and the material thereof are as known in the art, such as casting or forming the material into a curved shape.

The preferred material for the device is plastic piping, such as PVC pipe, which typically is stiff enough to stay upright and is lightweight. PVC pipe with a diameter of about one inches works well for the device. The cross-member of the device in all embodiments is preferably covered with foam or other soft coating 28 as shown in FIG. 5, particularly if there is concern about players hurting themselves by running into the device, or if the device is made of a more stiff material.

Figure 4:
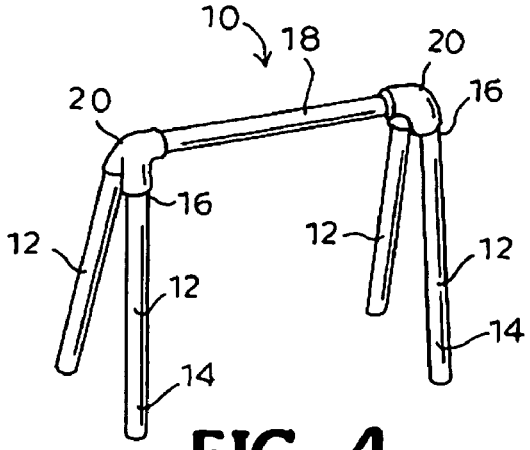
FIG. 4 is a perspective view of an alternative embodiment of the invention having two legs at each end.

To make the device more stable in use, there may be two legs at each end of the cross-member as shown in FIG. 4, which may be attached together as is known in the art for sawhorses and the like. It is important in this embodiment that the lower ends of the legs at each end are not widely spaced so that they do not stick out and cause the players to trip.

While the basketball dribble device may be fabricated in one-piece as shown in FIG. 1, most preferably the basketball dribble device is made in multiple pieces so that it may be assembled for use and then disassembled for storage or transport to another site. In this case, the device preferably comprises an elbow piece connecting the upper area of each leg to the cross-member as shown in FIG. 2.

The invention herein further comprises a method of teaching a player to cross-dribble, comprising: a) providing the player with a basketball dribble device as described above; and b) providing the player with a basketball and instructions as known in the art on how to crossover dribble.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A method for teaching a user proper crossover dribbling, comprising the steps of:

a) providing a basketball and a user instruction manual, b) providing a basketball dribble device to aid a user in achieving a proper crossover dribbling, the basketball dribble device comprising:

i) first and second support legs, each support leg having a lower portion and an upper portion, wherein the height of the first and second support legs is about 16 to 26 inches, wherein the height of the first and second support legs is adjustable;

ii) a rigid cross-member having first and second ends and extending between the upper portions of the first and second support legs, c) placing the lower portion of the first and second support legs on a floor surface suitable for dribbling the basketball;

d) adjusting the height of the basketball dribble device so that the cross-member is low enough to enable the basketball to pass beneath the cross-member and be properly crossover dribbled by the user, wherein the distances between the first and second legs, and the cross-member and the floor surface is large enough to allow a dribbled basketball to pass therethrough; and e) teaching proper crossover dribbling using the basketball dribble device.

2. The method for teaching the user proper crossover dribbling of claim 1, wherein the lower portion of the first and second support legs include a support member.

3. The method for teaching the user proper crossover dribbling of claim 1, wherein the height of the first and second support legs is preferably no more than 24 inches.

4. The method for teaching the user proper crossover dribbling of claim 2, wherein the cross-member is parallel to the floor surface when the support members are placed on the floor surface.

5. The method for teaching the user proper crossover dribbling of claim 1, wherein the cross-member is centrally arched.

6. The method for teaching the user proper crossover dribbling of claim 5, wherein the cross-member includes a soft coating.

7. The method for teaching the user proper crossover dribbling of claim 1, wherein the basketball dribble device is formed in one-piece.

8. The method for teaching the user proper crossover dribbling of claim 1, further comprising an elbow piece connecting each upper portion of the first and second support legs to the cross-member.

* * * * *